US005451149A

United States Patent [19]

Profaca et al.

[11] Patent Number: 5,451,149

[45] Date of Patent: Sep. 19, 1995

[54] ROTOR COOLING OF ROTARY ENGINES

[75] Inventors: Mark S. Profaca, Kew; George K. Cureton, Croydon, both of Australia

[73] Assignee: Scalzo Automotive Research Limited, Box Hill, Australia

[21] Appl. No.: 248,693

[22] Filed: May 25, 1994

[30] Foreign Application Priority Data

May 25, 1993 [AU] Australia ..... PL8954

[51] Int. Cl.[6] ..... F01C 21/06

[52] U.S. Cl. ..... 418/94

[58] Field of Search ..... 418/61.1, 61.2, 61.3, 418/91, 94, 144

[56] References Cited

U.S. PATENT DOCUMENTS

| | | | |
|---|---|---|---|
| 2,935,053 | 5/1960 | Brueder . | |
| 2,949,905 | 8/1960 | Brueder . | |
| 2,988,065 | 6/1961 | Wankel et al. . | |
| 2,988,070 | 6/1961 | Brueder . | |
| 3,103,208 | 9/1963 | Price et al. . | |
| 3,131,379 | 4/1964 | Holt . | |
| 3,131,679 | 5/1964 | Peras | 418/61.3 |
| 3,154,061 | 10/1964 | Biabaud . | |
| 3,253,582 | 5/1966 | Ortlieb . | |
| 3,266,468 | 8/1966 | Peras . | |
| 3,381,848 | 5/1968 | Brown . | |
| 3,410,254 | 11/1968 | Huf . | |
| 3,444,852 | 5/1969 | Biabaud . | |
| 3,465,613 | 9/1969 | Biabaud . | |
| 4,025,245 | 5/1977 | Goloff | 418/94 |
| 4,772,189 | 9/1988 | Garside | 418/61.2 |

FOREIGN PATENT DOCUMENTS

| | | |
|---|---|---|
| 1024504 | 3/1966 | United Kingdom . |
| 1042722 | 9/1966 | United Kingdom . |

*Primary Examiner*—Richard A. Bertsch
*Assistant Examiner*—Charles G. Freay
*Attorney, Agent, or Firm*—Merchant, Gould, Smith, Edell, Welter & Schmidt

[57] ABSTRACT

A multi-lobed trochoidal rotor for a trochoidal rotary engine includes main body defining at least two lobes, a trochoidal peripheral surface, side faces forming part of side faces of the rotor and a substantially central bore. Each side face of the body is recessed over each lobe and a plurality of the angularly spaced apertures in each lobe provide communication between the recessed part of each side face. Closure means neatly received in each recessed area complete a respective side face of the rotor. A plurality of passageways extend through the body, outwardly from the bore and include in each lobe at least one supply passageway and at least one return passageway terminating adjacent to an inner face respectively of a first and second closure means. Pressurized oil supplied to the bore is able to flow in each lobe through the at least one supply passageway, the plurality of apertures and the at least one return passageway, to an outlet adjacent the bore. A respective side seal groove extends circumferentially in each side face to receive a side seal for sealing with an engine housing in which the rotor is mountable.

8 Claims, 3 Drawing Sheets

ROTOR COOLING OF ROTARY ENGINES

BACKGROUND OF THE INVENTION

Generally the present invention relates to the cooling of the rotor trochoidal rotary internal combustion engines of the spark ignition and compression ignition types.

Rotary piston engines to which the present invention relates have a multi-lobed piston member (hereinafter referred to as a "rotor") rotatably mounted on a crankpin of a crankshaft, with the crankshaft rotatably mounted in a housing. The multi-lobed rotor has the shape of a trochoid or of a curve inside and parallel to a trochoid, while the housing has an inner surface shape corresponding respectively to the outer enclosing curve, or outer envelope, of the trochoid or of the inside parallel curve; these alternatives hereinafter being encompassed by reference to "trochoid" or the "outer enclosing curve, or envelope" thereof. Rotational phasing of the rotor relative to the shaft and the housing is ensured by an external gear which is fixed to the rotor and which meshes with an internal gear fixed to the housing. The trochoid has at least two lobes and theoretically it can have any greater number of lobes. The number of lobes determines the gear ratio required for phasing and also the number of working chambers in the housing; the number of such chambers being equal to the number of lobes plus one. Thus a family of trochoidal piston rotary engines exists. The present invention is particularly relevant to two lobe trochoid rotary piston engines with three working chambers, and the following description largely is directed to engines which have a single two lobe, trochoid shaped rotor. However, the invention extends to engines having more than one rotor and to engines having at least one rotor with three or more lobes.

It is known that rotors of a rotary engine require cooling to dissipate heat absorbed during the combustion process. In addition rotors are also subjected to mechanical stresses particularly during combustion, and it is essential that distortion of the rotor peripheral and side surfaces is kept to a minimum to avoid loss of gas pressure and thus performance.

Although the prior art, such as illustrated by U.S. Pat. No. 3,131,379 and 3,266,468 to Pears, recognises the need for rotor cooling by oil or water, the proposed large channels and thin walled rotor construction fail to allow for the distorting forces produced during combustion. For high speed engines where there is a need for a lightweight rotor generally made from materials such as an aluminium or magnesium alloy or graphite, the construction as suggested by the cited marks would not be suitable or possible. For these materials the rotor needs to be substantially solid if distortions are to be kept to acceptable levels and maintain sealing integrity between the rotor surface and apex seals, and between the compression side seals and engine side plates. We have confirmed this requirement by extensive computer analysis and testing.

It is an objective of this invention to provide a rotor better adapted to provide for oil cooling of the rotor.

SUMMARY OF THE INVENTION

The present invention provides a trochoidal rotor of at least two lobes, the rotor having substantially parallel, substantially planar side faces and an outer peripheral surface which extends around and joins the side faces. The outer surface defines a trochoid, or an outer enclosing curve or envelope thereof, and is substantially parallel to a centrally disposed bore extending between the side faces. When mounted in an engine, the crank pin of the crank shaft is journalled in the bore, with the piston rotatable oppositely with respect to the crankshaft on a bearing provided in the bore, around the crankpin.

The rotor includes a main body which defines the peripheral surface and has side faces corresponding generally to those of the rotor. Each side face of the body defines a respective side face of the rotor, around at least an outer peripheral margin of the latter. However, each side face of the body is recessed over part of the area of each lobe. Where recessed, the body defines a plurality of apertures or slots in each lobe which provide communication through the body, between each of its side faces. The rotor also includes, for each side face of the body, at least one closure means which is attachable to the body. The configuration of the closure means for each side face of the body is such as to be neatly received in the recessed area to complete a respective substantially planar side face of the rotor.

The rotor also includes passageways which extend through the body, outwardly with respect to the bore. The passageways include at least one supply passageway which extends from the bore and terminates adjacent an inner face of a first closure means, such that pressurised oil supplied to the bore is able to flow through the at least one supply passageway and thereafter flow through the apertures or slots in at least one lobe. The passageways also include at least one return passageway which terminates adjacent the inner face of second closure means which is axially aligned with the first closure means, such that oil flowing through the apertures or slots is able to return, via the return passageway, to an outlet adjacent to the bore.

The rotor also includes a respective peripheral side seal groove formed in each side face, adjacent to the outer peripheral surface, for receiving a respective side seal for sealing engagement with a respective side plate of an engine housing.

In a first form of the invention, each side seal groove is defined by a respective side face of the body, within the radial extent of the outer peripheral margin thereof. In that first form, each side face of the body is recessed over at least one area which is radially within its side seal groove, either over a respective area of each lobe or over an area extending over each lobe. Where each side face of the body is recessed over a respective area of each lobe, a respective closure means is provided for each lobe for each side face of the body. Where each side face of the body is recessed over an area extending over each lobe, there may be one closure means for each side face of the body which extends over each lobe.

In a second form of the invention, a radially outer side face of each side seal groove is defined by a radially inwardly facing side of the outer peripheral margin of the body, with the body being recessed over substantially all of each side face inwardly from that margin. In that second form, there is a single closure means for each side face of the body, with each closure means having an outer periphery which defines a radially inner side face of the respective side seal groove.

In a first embodiment, in accordance with the first form of the invention, the body is recessed at each of its side faces, over a respective area for each lobe, with the respective area for each lobe extending angularly around the lobe and bounded by radially outer and inner arcuate edges. A respective closure means for each such area is of similar form, such as to be neatly received in its recessed area. The closure means preferably has a peripheral side edge around which it is grooved, such that a seal provided in the groove ensures a fluid tight seal between the body and the closure means, around the periphery of the recessed area. Within the recessed area of each side face of the body for each lobe, the body defines an angularly spaced array of substantially radial slots through which oil can be circulated, as described above. A cavity is defined between each closure means and an adjacent end of the slots, to facilitate supply of oil to, and return oil from, all of the slots extending between respective recessed areas of each side face of the body.

In a second embodiment, also in accordance with the first form of the invention, the body is recessed at each of its side faces over substantially its entire area inwardly of the outer peripheral margin thereof, such that the area extends over each lobe. A single closure means for each side face has an outer periphery of a form complementary to that of the recessed area. Adjacent to and around the outer periphery of the recessed area, a fluid tight seal is provided between each side face of the body and its closure means, while a further fluid tight seal is provided therebetween around and adjacent to the bore. In each lobe, the body defines an angularly spaced plurality of radial slots through which oil can be circulated as discussed above. A cavity is defined between each closure means and an adjacent end of the slots of each lobe, again to facilitate the supply and return of oil which flows through each slot of each lobe.

In a third embodiment of the invention, in accordance with the second form of the invention, the arrangement is similar to that of the second embodiment. However, in the third embodiment, the outer periphery of each closure means defines an inner side face of the respective side seal groove.

In each form of the invention, the body is formed of a suitable metal, such as an aluminium or magnesium alloy. The closure means may be of a similar alloy, but preferably one having a slightly higher co-efficient of thermal expansion than the alloy used for the body. The closure means alternatively may be of steel, and this is highly desirable in each of the second and third embodiments of the invention.

The invention will now be described with reference to the accompanying drawings, in which.

DETAILED DESCRIPTION OF THE INVENTION

Figure 2:
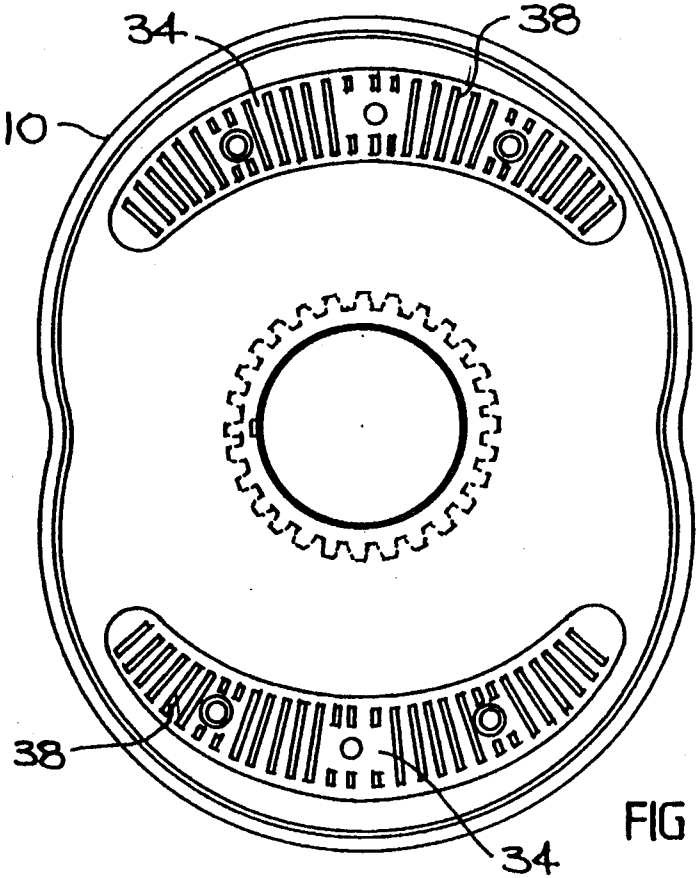
FIG. 2 is a frontal view of a rotor body of the rotor of FIG. 1.
Figure 1:
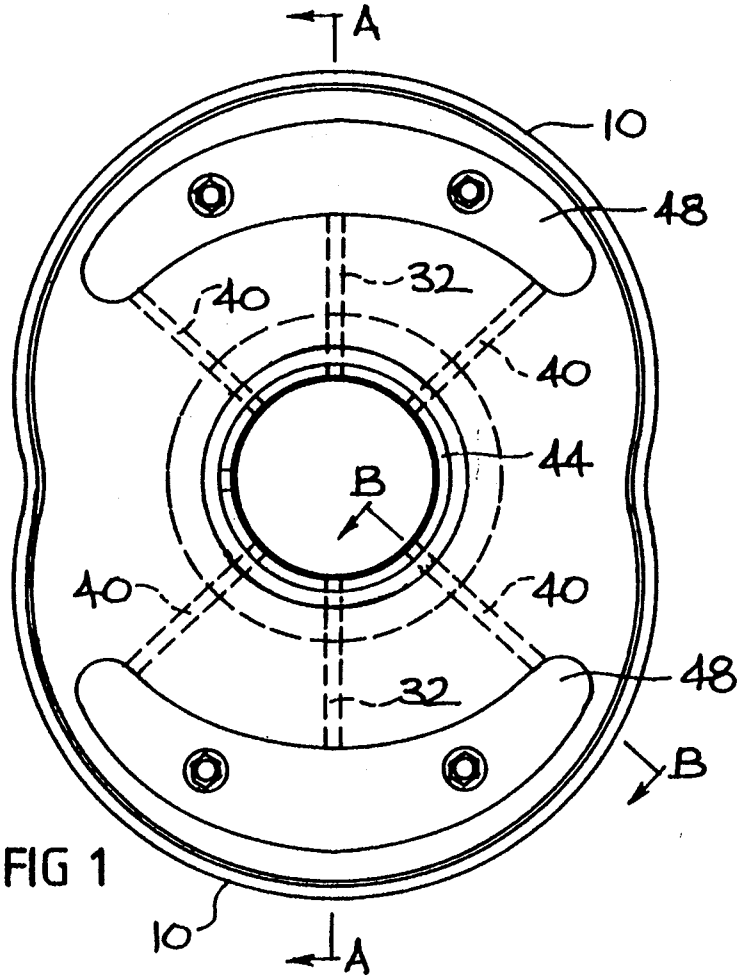
FIG. 1 is a frontal view of the two lobe rotor of a first embodiment of the invention taken on line I—I of FIG. 3.
Figure 3:
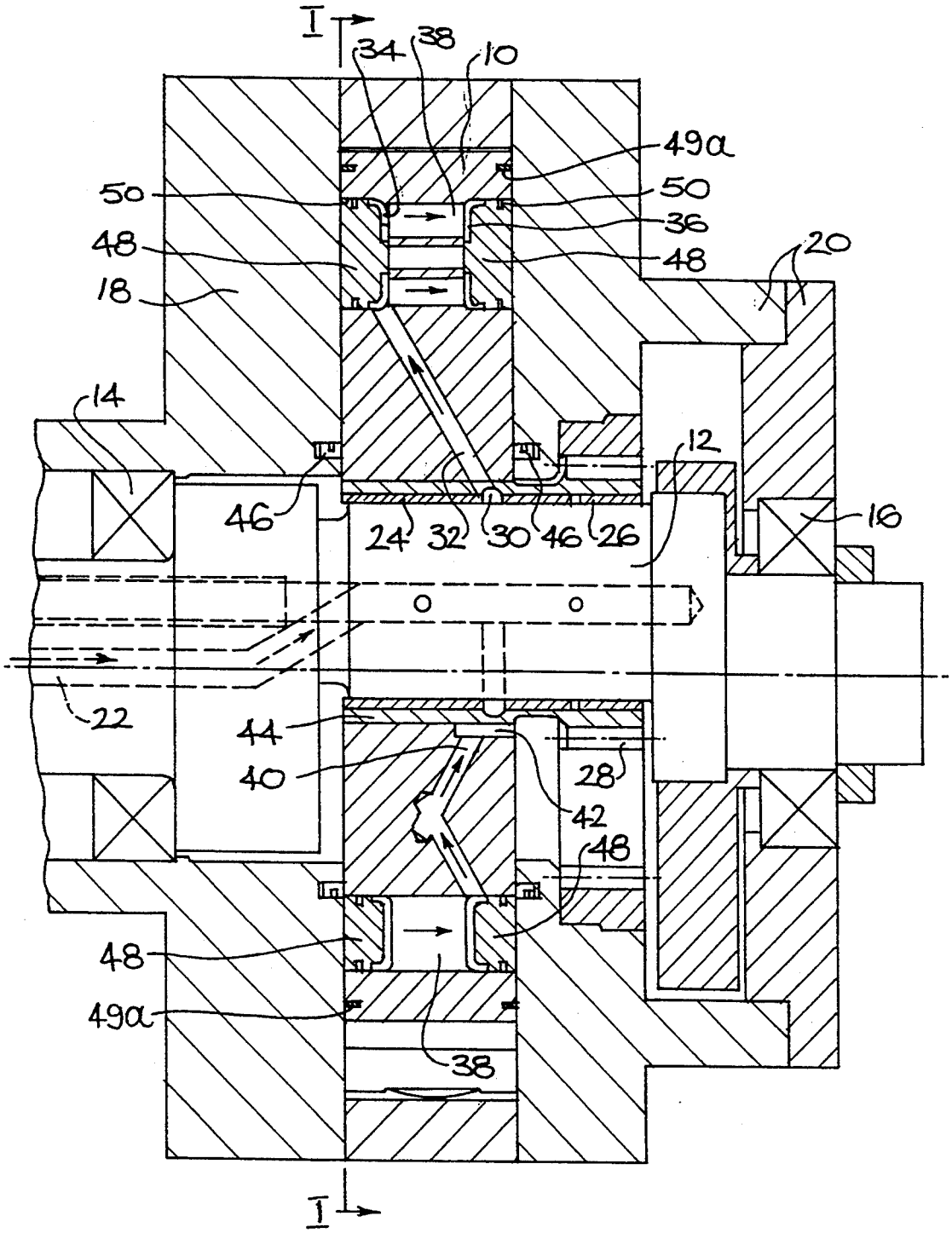
FIG. 3 is a cross-section of the engine having the rotor of FIG. 1, taken relative to line III—III through FIG. 1.

Referring to FIGS. 1 to 3, there is shown a two lobe rotor 10 which, in FIG. 3, is mounted on a crankshaft 12; with crankshaft 12 rotatably supported on two bearing 14 and 16 in the front and rear engine side plates 18 and 20 respectively. Lubricating oil which is also used for cooling, enters the crankshaft 12 via a longitudinal duct 22 within crankshaft 12. Duct 22 provides oil to rotor 10, bearing 24, bearing 26 under the rotor gear 28 and cooling oil groove 30. Cooling oil groove 30 communicates with ducts 32 in both lobes of rotor 10, leading to one side of recessed crescent shaped cooling area 34. Cooling oil spreads along the front side of recessed crescent shaped cooling area 34 and flows towards the rear side of crescent shaped cooling area 36 via radial slots 38. The large surface area provided by slots 38 cools the rotor 10 to acceptable levels. The heated oil returns to the engine sump (not shown) via oil grooves 40 communicating with the ends of a crescent shaped area 36 on the rear side of rotor 10, and via slots 42 near the bearing sleeve 44.

The oil is prevented from entering the combustion chamber (not shown) or the engine ports (not shown), by scraping oil rings 46 located in the front and rear engine plates 18 and 20. Crescent shaped sealing plates 48 seal the cooling areas of rotor 10 by peripheral "O" ring seals 50. The close fitting of sealing plates 48 into a corresponding shape in the rotor 10 faces, also perform the function of providing support to the rim of rotor 10. The sealing plates 48 may be made of a material with a slightly higher expansion coefficient than the rotor 10 material to allow for the machining and assembly clearance of the two mating surfaces and thus contribute to the structural strength of the assembled rotor 10. For example, the rotor 10 may be made of a first aluminium alloy but the sealing plates 48 made of another aluminium alloy that has a slightly higher coefficient of expansion than the first alloy, or may be made from a magnesium alloy which has a higher coefficient of expansion than that of the aluminium alloy of the rotor body.

It is evident from the construction design that the cooling slots 38 provide a large surface area for cooling without compromising the structural integrity of the rotor 10.

In this first embodiment the inner diameter of the crescent shaped plates 48, is governed by the rubbing surface provided for the scraping oil rings 46. Also the outer diameter of plates 48 is governed by side seal groove 49 defined in each side face of rotor 10; groove 49 accommodating a side seal **49*a* as shown in FIG. 3**.

It is to be noted that additional oil inlet ducts 32 may be added as well as additional exhaust oil ducts 40 and slots 42, to the design if required.

Figure 5:
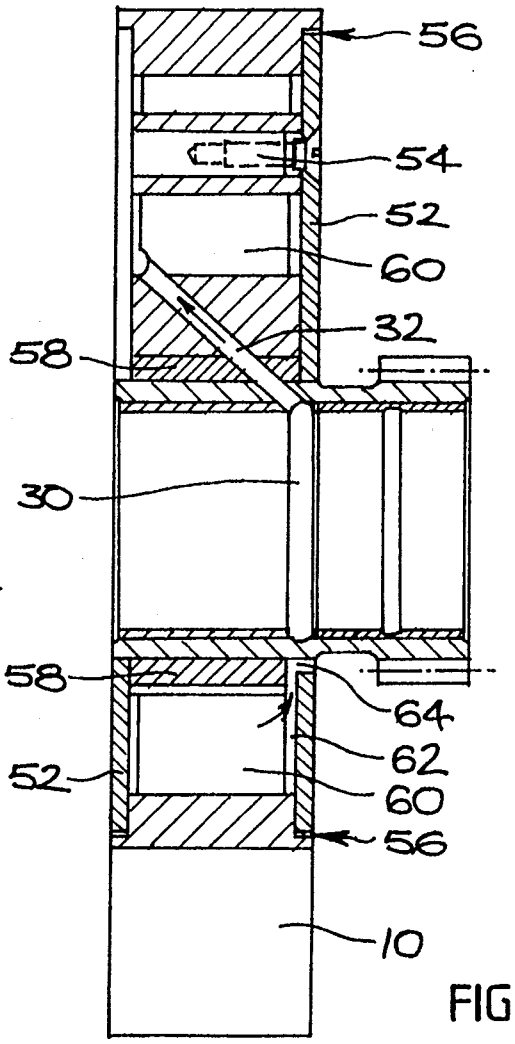
FIG. 5 is a cross-section of the rotor of FIG. 4, taken on line V—V of FIG. 4.
Figure 4:
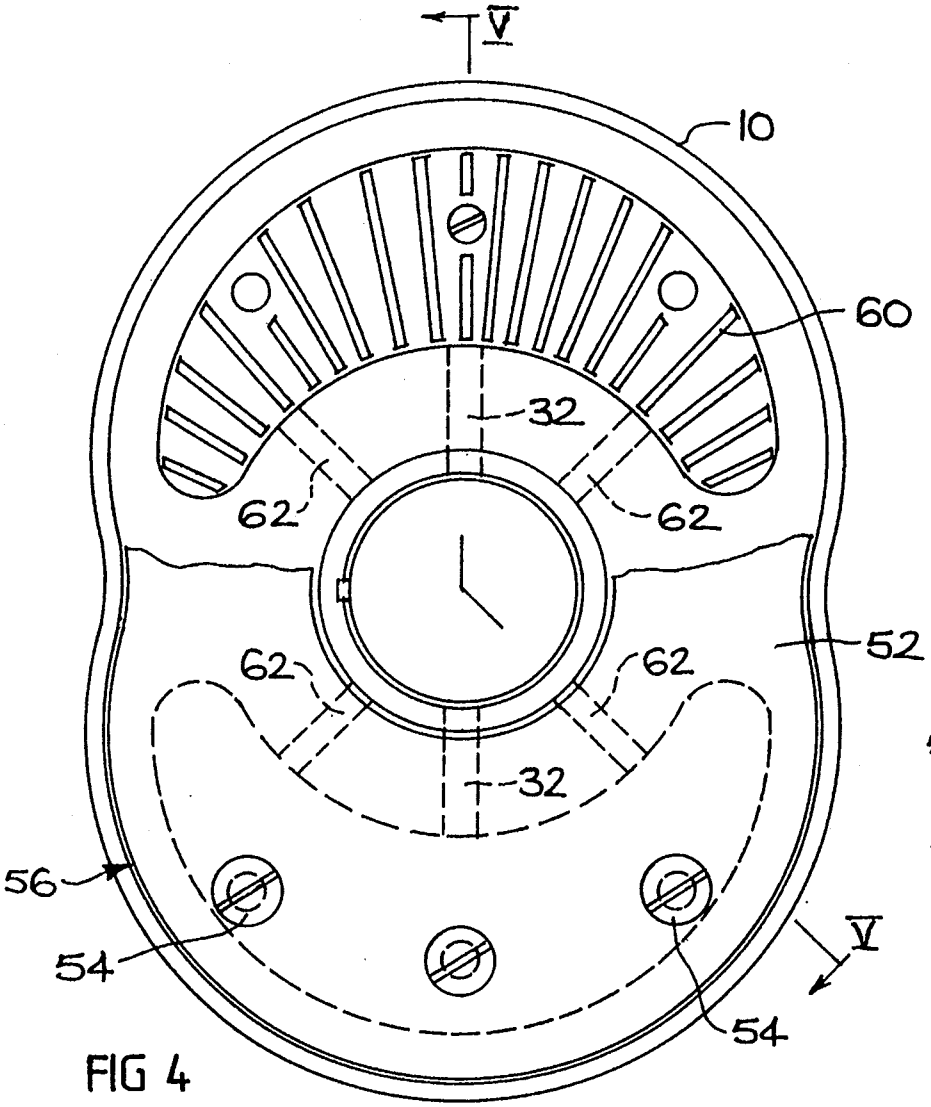
FIG. 4 is a frontal view of the body of a two lobed rotor of a second embodiment of the invention.

FIGS. 4 and 5 show a second embodiment of the invention in which the front side plate 52 is shown as partly removed in FIG. 4. In the second embodiment, increased cooling area in the rotor 10, beyond the rubbing surface area of the oil seals 46 of FIG. 3, is achieved by the addition of a respective rotor side plate 52 over each face of the rotor 10. Side plates 52 are held against the front and rear faces of rotor 10 by screws, or rivets or bolts 54 positioned outside the wiping area of oil seals 46 (of FIG. 3) rubbing against the side plates 52.

Side plates 52 are extended radially to form the inner face of groove 56 for the compression seal (not shown). This method of forming groove 56 reduces machining costs and improves surface finish for better sealing of the compression seal. Side plates 52 are also sealed and fixed to the steel hub 58 cast into rotor 10.

Radial cooling slots 60 are now able to be made as large as necessary for increased cooling. Oil inlet ducts 32 allow oil to be along the front face of rotor 10, forced through cooling slots 60 and returned to the sump via channels 62 and slots 64.

Side plates 52 may be made of similar material to that of rotor 10, or of dissimilar material such as steel. If dissimilar metals are used, the fixing screws or bolts 54 must be given radial clearance to allow expansion differences.

Finally, it is to be understood that various alterations, modifications and/or additions may be introduced into the constructions and arrangements of parts previously described without departing from the spirit or ambit of the invention.

The claims defining the invention are as follows:

1. A multi-lobed trochoidal rotor for a trochoidal rotary engine, said rotor having two substantially parallel, substantially planar side faces and an outer peripheral surface which defines a trochoid having at least two-lobes and which extends around and joins the side faces; wherein said rotor includes:

i) a main body which defines said lobes and said peripheral surface and has side faces corresponding to and forming part of the side faces of the rotor, wherein the main body defines a substantially central bore through its side faces, wherein each said side face of the main body is recessed over part of its area over each lobe, and wherein the body defines a plurality of angularly spaced apertures in each lobe which provide communication through the body between the recessed part of the area of each of its side faces;

ii) for each side face of the body, at least one closure means attached to the body and configured so as to be neatly received in the recessed area to complete a respective substantially planar side face of the rotor, iii) a plurality of passageways which extend through the body, outwardly with respect to the bore, wherein said plurality of passageways includes in each lobe at least one supply passageway, which extends from the bore and terminates adjacent an inner face of a first said closure means in its lobe, and wherein said plurality of passageways further includes in each lobe at least one return passageway which terminates adjacent to an inner face of a second said closure means in its lobe, such that pressurized oil supplied to the bore is able to flow through the at least one supply passageway in each lobe, thereafter flow through the plurality of angularly spaced apertures in each lobe, and thereafter flow through the return passageway in each lobe, to an outlet adjacent the bore; and, iv) a respective side seal groove in each side face of the rotor, wherein each side seal groove extends circumferentially adjacent to the outer peripheral surface, and is adapted to receive a respective side seal for sealing engagement with a respective side plate of an engine housing in which the rotor is mountable.

2. A trochoidal rotor according to claim 1 wherein each side seal groove is defined within a respective outer peripheral margin of a respective said side face of the body, within the radial extent of the outer peripheral surface, and wherein each side face of the body is recessed over at least one area which is radially within its side seal groove.

3. A trochoidal rotor according to claim 2 wherein each side face of the body is recessed over a respective area of each lobe, and a respective said closure means is provided at each lobe for each side face of the body.

4. A multi-lobed trochoidal rotor for a trochoidal rotary engine, said rotor having two substantially parallel, substantially planar side faces and an outer peripheral surface which defines a trochoid having at least two-lobes and which extends around and joins the side faces; wherein said rotor includes:

i) a main body which defines said lobes and said peripheral surface and has side faces corresponding to and forming part of the side faces of the rotor, wherein the main body defines a substantially central bore through its side faces, wherein each said side face of the main body is recessed over part of its area over each lobe, and wherein the body defines a plurality of angularly spaced apertures in each lobe which provide communication through the body between the recessed part of the area of each of its side faces;

ii) for each side face of the body, at least one closure means attached to the body and configured so as to be neatly received in the recessed area to complete a respective substantially planar side face of the rotor, iii) a plurality of passageways which extend through the body, outwardly with respect to the bore, wherein said plurality of passageways includes in each lobe at least one supply passageway, which extends from the bore and terminates adjacent an inner face of a first said closure means in its lobe, and wherein said plurality of passageways further includes in each lobe at least one return passageway which terminates adjacent to an inner face of a second said closure means in its lobe, such that pressurized oil supplied to the bore is able to flow through the at least one supply passageway in each lobe, thereafter flow through the plurality of angularly spaced apertures in each lobe, and thereafter flow through the return passageway in each lobe, to an outlet adjacent the bore; and, (iv) a respective side seal groove in each side face of the rotor wherein each side seal groove extends circumferentially adjacent to the outer peripheral surface, and is adapted to receive a respective side seal for sealing engagement with a respective side plate of an engine housing in which the rotor is mountable;

wherein each side seal groove is defined within a respective outer peripheral margin of a respective side face of the body, within the radial extent of the outer peripheral surface, each side face of the body is recessed over at least one area which is radially within its seal groove, and wherein each side face of the body is recessed over an area extending over each lobe and a single respective closure means is provided for each side face of the body so as to extend over each lobe.

5. A multi-lobed trochoidal rotor for a trochoidal rotary engine, said rotor having two substantially parallel, substantially planar side faces and an outer peripheral surface which defines a trochoid having at least two-lobes and which extends around and joins the side faces; wherein said rotor includes:

i) a main body which defines said lobes and said peripheral surface and has side faces corresponding to and forming part of the side faces of the rotor, wherein the main body defines a substantially central bore through its side faces, wherein each said side face of the main body is recessed over part of its area over each lobe, and wherein the body defines a plurality of angularly spaced apertures in each lobe which provide communication through the body between the recessed part of the area of each of its side faces;

ii) for each side face of the body, at least one closure means attached to the body and configured so as to be neatly received in the recessed area to complete a respective substantially planar side face of the rotor, iii) a plurality of passageways which extend through the body, outwardly with respect to the bore, wherein said plurality of passageways includes in each lobe at least one supply passageway, which extends from the bore and terminates adjacent an inner face of a first said closure means in its lobe, and wherein said plurality of passageways further includes in each lobe at least one return passageway which terminates adjacent to an inner face of a second said closure means it its lobe, such that pressurized oil supplied to the bore is able to flow through the at least one supply passageway in each lobe, thereafter flow through the plurality of angularly spaced apertures in each lobe, and thereafter flow through the return passageway in each lobe, to an outlet adjacent the bore; and, iv) a respective side seal groove in each side face of the rotor wherein each side seal groove extends circumferentially adjacent to the outer peripheral surface, and is adapted to receive a respective side seal for sealing engagement with a respective side plate of an engine housing in which the rotor is mountable;

wherein each side face of the body is recessed over a respective area of each lobe and a respective said closure means is provided for each lobe at each side face of the body, wherein the recessed areas for each lobe extends angularly around the lobe and are bounded by radially outer and inner arcuate edges and the respective closure means for each such area is of a complimentary form such as to be neatly received in the recessed area; wherein, within the recessed areas, the plurality of apertures defined by the body in each lobe comprises an angularly spaced array of substantially radial slots through which oil can be circulated, and wherein a cavity is defined between each closure means and adjacent ends of respective said slots, to facilitate supply of oil to, and from, all of the slots.

6. A trochoidal rotor according to claim 4 wherein the recessed areas of the body extend substantially over each of its faces inwardly of the outer peripheral margin, wherein, within the recessed areas, the plurality of angularly spaced apertures defined by the body in each lobe comprises an angularly spaced plurality of radial slots through which oil can be circulated, and wherein a cavity is defined between each closure means and adjacent ends of the slots of each lobe to facilitate the supply of oil to, and the return of oil from, each slot of each lobe.

7. A multi-lobed trochoidal rotor for a trochoidal rotary engine, said rotor having two substantially parallel, substantially planar side faces and an outer peripheral surface which defines a trochoid having at least two-lobes and which extends around and joins the side faces; wherein said rotor includes:

i) a main body which defines said lobes and said peripheral surface and has side faces corresponding to and forming part of the side faces of the rotor, wherein the main body defines a substantially central bore through its side faces, wherein each said side face of the main body is recessed over part of its area over each lobe, and wherein the body defines a plurality of angularly spaced apertures in each lobe which provide communication through the body between the recessed part of the area of each of its side faces;

ii) for each side face of the body, at least one closure means attached to the body and configured so as to be neatly received in the recessed area to complete a respective substantially planar side face of the rotor, iii) a plurality of passageways which extend through the body, outwardly with respect to the bore, wherein said plurality of passageways includes in each lobe at least one supply passageway, which extends from the bore and terminates adjacent an inner face of a first said closure means in its lobe, and wherein said plurality of passageways further includes in each lobe at least one return passageway which terminates adjacent to an inner face of a second said closure means it its lobe, such that pressurized oil supplied to the bore is able to flow through the at least one supply passageway in each lobe, thereafter flow through the plurality of angularly spaced apertures in each lobe, and thereafter flow through the return passageway in each lobe, to an outlet adjacent the bore; and, iv) a respective side seal groove in each side face of the rotor wherein each side seal groove extends circumferentially adjacent to the outer peripheral surface, and is adapted to receive a respective side seal for sealing engagement with a respective side plate of an engine housing in which the rotor is mountable;

wherein a radially outer side face of each side seal groove is defined by a radially inwardly facing side of an outer peripheral margin of the body, the body is recessed over substantially all of each side face thereof inwardly from that margin, and wherein there is a single closure means for each side face of the body, with each closure means having an outer periphery which defines a radially inner side face of the respective side seal groove.

8. A trochoidal rotor according to claim 7 wherein a respective said recessed area of the body extends substantially over each side face of the body inwardly of the outer peripheral margin, wherein the plurality of angularly spaced apertures defined by the body in each lobe comprises an angularly spaced plurality of radial slots through which oil can be circulated, and wherein a cavity is defined between each closure means and an adjacent end of the slots of each lobe, to facilitate the supply of oil to, and the return of oil from, each slot of each lobe.

* * * * *